United States Patent [19]

Mayer

[11] Patent Number: 4,907,486

[45] Date of Patent: Mar. 13, 1990

[54] LIQUID PROPELLANT GUN

[75] Inventor: Robert E. Mayer, Williamstown, Mass.

[73] Assignee: General Electric Company, Pittsfield, Mass.

[21] Appl. No.: 840,104

[22] Filed: Oct. 6, 1977

[51] Int. Cl.[4] ..... F41F 1/04

[52] U.S. Cl. ..... 89/7

[58] Field of Search ..... 89/1 R, 7; 102/38 R, 102/38 LP, 8

[56] References Cited

U.S. PATENT DOCUMENTS

| | | | |
|---|---|---|---|
| 2,397,800 | 4/1946 | McArthur | 89/8 |
| 2,965,000 | 12/1960 | Skinner | 89/7 X |
| 3,138,990 | 6/1964 | Jukes et al. | 89/7 |
| 3,763,739 | 10/1973 | Tossie | 89/1 R X |
| 4,033,224 | 7/1977 | Holtrop | 89/1 R X |
| 4,050,349 | 9/1977 | Graham | 89/7 |

*Primary Examiner*—David H. Brown

*Attorney, Agent, or Firm*—Bailin L. Kuch; Francis K. Richwine

[57] ABSTRACT

A liquid propellant gun system has an annular differential piston journaled for telescopic movement with respect to an annular control valve and to the chamber of the firing bore; uses the piston, the valve and the projectile as valve means for controlling the injection of liquid propellant into the combustion chamber of the gun system; uses a displacement type control means to limit the rate of the loading of liquid propellant and to provide a positive evacuation of misfired liquid propellant from the combustion chambers; and incorporates a vernier control circuit to give direct control over the performance of the gun.

10 Claims, 2 Drawing Sheets

LIQUID PROPELLANT GUN

BACKGROUND OF THE INVENTION

1. Field of the Invention

This invention relates to liquid propellant guns utilizing a differential piston to provide continued or regenerative injection of propellant into the combustion chamber.

2. Prior Art

Liquid propellant guns utilizing differential pistons to pump propellant into the combustion chamber during combustion are now well known. Early work is described in a Final Report of Nov. 19, 1953-Jan. 31, 1956 under contract DA-36-034-ORD-1504RD, Project TS1-47-8 by V. M. Barnes, Jr. et al which apparently in part corresponds to Jukes et al, U.S. Pat. No. 3,138,990, filed Oct. 9, 1961; in a report No. 17-2 of June 15, 1954 under contract NOrd-10448 by C. R. Foster et al; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al, U.S. Pat. No. 2,981,153, filed Nov. 14, 1952; C. M. Hudson, U.S. Pat. No. 2,986,072, filed Nov. 19, 1952; E. J. Vass et al, U.S. Pat. No. 3,690,255, filed Oct. 1, 1970; and D. P. Tassie, U.S. Pat. No. 4,023,463, filed June 10, 1976. A round of ammunition having a differential piston which is coaxial with the firing bore is shown by E. Ashley in Ser. No. 469,507, filed May 13, 1974, now abandoned. Reference may also be made to an article "Direct Injection Liquid Propellant Gun Technology" by Penn, Campbell and Bulman, CPAI Publication 280, June 1977, pp 257–303, which shows a differential piston which is coaxial with a firing bore in a gun.

RELATED APPLICATIONS

This application is related to an application of M. J. Bulman filed concurrently (application Ser. No. 840,074 filed Oct. 6, 1977). The applications which are based on the same disclosure are owned by the same assignee each claim different aspects of the subject matter disclosed.

SUMMARY OF THE INVENTION

An object of this invention is the provision of a liquid propellant gun system having a differential piston which is coaxial with the firing bore wherein the projectile may be fed longitudinally, forwardly into the chamber of the firing bore.

Another object of this invention is the use of a projectile as a valving means for controlling the injection and rate of flow of liquid propellant into the combustion chamber to provide for a progressive or staged rate of injection.

Another object is the provision of such a gun system wherein the timing of the loading of the liquid propellant and the timing of the loading of the projectile are substantially mutually independent.

A feature of this invention is the provision of a liquid propellant gun system having an annular differential piston journaled for telescopic movement with respect to an annular control valve and to the chamber of the firing bore.

Another feature of this invention is the use of the piston, the valve and the projectile as valve means for controlling the injection of liquid propellant into the combustion chamber of the gun system.

DESCRIPTION OF THE INVENTION

Figure 1:
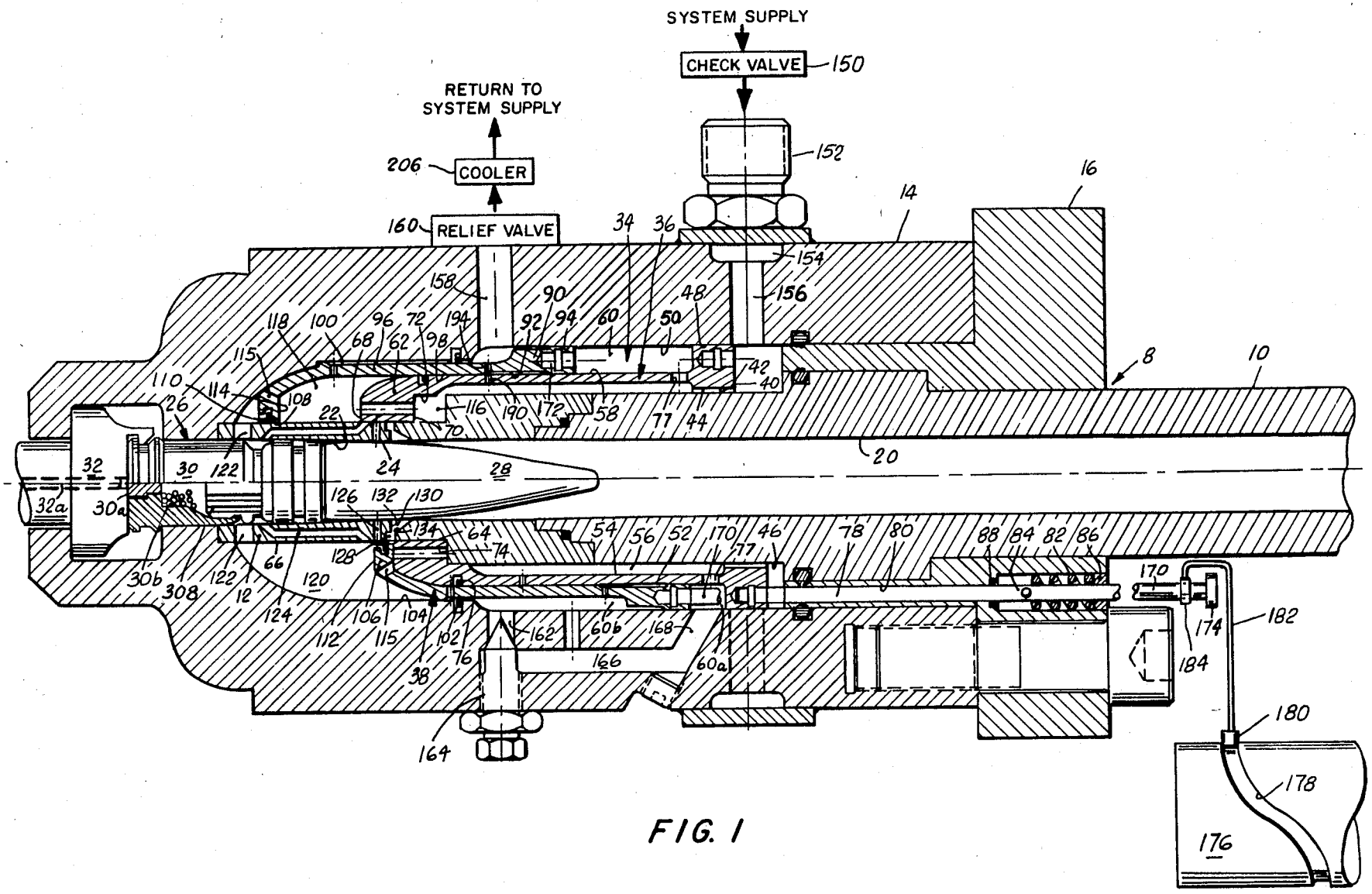
FIG. 1 is a view in elevation, in longitudinal cross-section, of a gun system embodying this invention. The lower half of the view shows the assembly prior to filling with liquid propellant, while the upper half shows the assemby after filling and prior to firing.

The gun system includes a gun barrel assembly 8 which consists of a forward barrel 10 which is fixed to a barrel extension 12 within a breech or housing 14 by a cover 16. The barrel assembly has a rifled firing bore 20, a projectile receiving chamber 22 which also serves as a combustion chamber, and an intermediate forcing cone 24. A round of ammunition 26 comprising a projectile 28 crimped to a stub case 30 having a percussion primer **30*a* and a booster charge 30*b* is chambered, locked and extracted by a conventional bolt 32**, or, in a large caliber gun, a breech block.

The barrel assembly in conjunction with the housing 14 define a substantially hollow cylindrical cavity 34 in which are telescopically disposed a substantially hollow cylindrical valve 36 and a substantially hollow cylindrical piston 38.

The valve 36 includes a forward annular portion 40 having an inner wall surface 42 providing an annular gap or passageway 44 adjacent the outer wall surface 46 of the barrel and having an outer wall surface 48 journaled on the inner wall surface 50 of the housing and substantially sealed thereto. The annular portion 40 is integral with an intermediate tubular portion 52 having an inner wall surface 54 providing an annular cavity 56 adjacent the outer wall surface 46, having and an outer wall surface 58 providing an annular cavity 60 adjacent the inner wall surface 50 of the housing. The intermediate portion 52 is ntegral with an aft annular portion 62 having an inner wall surface 64 journaled on the outer wall surface 66 of the barrel extension and substantially sealed thereto, a transverse aft surface 68, a transverse forward surface 70, an inner annular surface 72, a plurality of longitudinal bores or passageways 74 extending between the surfaces 68 and 70, and a ring seal 76 disposed in an annular groove in the outer wall surface 58. A plurality of radial bores 77 are also provided in the intermediate portion 52 to provide a passageway between the inner cavity 56 and the outer cavity 60. Two rods 78 have their aft ends respectively fixed to the forward annular portion 40, and pass through bores 80 in the housing. The rods are each biased aftwardly by a respective helical compression spring 82 captured between a cross pin 84 on the rod and a plug 86 in the housing. Each rod may have a respective seal 88.

The piston 38 includes a forward annular portion 90 having an inner wall surface 92 journaled on the surface 58 of the valve and an outer wall surface 94 journaled on the surface 50 of the housing. The annular portion 90 is integral with an intermediate tubular portion 96 having an inner surface 98 bearing against the ring seal 76 in the valve, and an outer surface 100 bearing against a high performance ring seal 102 disposed in an annular groove in the inner surface 104 of the housing. The intermediate portion 96 is integral with an aft annular portion 106 having an inner wall surface 108 in which is mounted an L type ring seal 110 which is journaled on and seals to the outer surface 66 of the barrel extension, a transverse aft surface 112, a transverse forward surface 114, and a plurality of bores or passageways 115 extending between the surfaces 112 and 114. It will be seen that the effective cross-sectional area of the forward surface 114 is less than the effective cross-sectional area of the aft surface 112, providing the piston sleeve 38 with a differential piston action.

The barrel extension 12, the valve 36 and the piston 38, depending on their mutual positioning, may be considered to define a liquid propellant supply cavity 116, a pumping cavity 118, and an additional combustion cavity 120. The barrel extension 12 has a first plurality of radial passageways 122 disposed aft in an annular row, serving as passageways between the combustion chamber 120 and the projectile chamber 22; a second plurality of passageways 124, a third plurality of passageways 126 and a fourth plurality of passageways 128, each plurality disposed in a respective annular row and serving as passageways between the pumping chamber 118 and the projectile chamber 22. The passageways 128 comprise a plurality of radial bores terminating in a common annular groove 130 providing a shoulder 132 partially obstructing each bore in the aft firing bore direction and a surface 134 at an obtuse angle to the surface of the firing bore in the forward direction.

A check valve 150 is coupled to an inlet 152 in the housing 14 which leads to an annular passageway 154 in the housing, from which a plurality of radial bores 156 lead to and through the forward portion of the surface 50. A radial bore 158 leads through and from the surface 50 aft of the annulus 90 of the piston 38 to a relief valve 160. A radial bore 162 aft of the annulus 90 of the piston 38, in which is seated a needle valve 164, communicates with a bore 166, which communicates with a bore 168 which leads to and through the surface 50 forward of the annulus 90.

Two rods 170 and 172 have their aft ends respectively fixed to the forward annular portion 90 of the piston 38, and pass through bores with seals in the housing which are similar to the bores 80. The forward ends of the rods respectively terminate in an enlargement 174. A drum cam 176, such as is shown in U.S. Pat. No. 3,763,739 filed June 1, 1971, by D. P. Tassie, has a helical control track 178 in which rides a cam follower 180 which has an arm 182 which terminates in a rod follower 184. The rods are free to move forwardly free of the follower 180, but are controlled in their movement aftwardly by the cam track 178 via the followers 180 and 184. The cam track 178 is also able to pull the rods forwardly via the followers 180 and 184. The enlargement 174 and the rod follower 184 serve as a clutch, i.e., a coupling used to connect and disconnect a driving and driven part of a mechanism.

OPERATION

Figure 2:
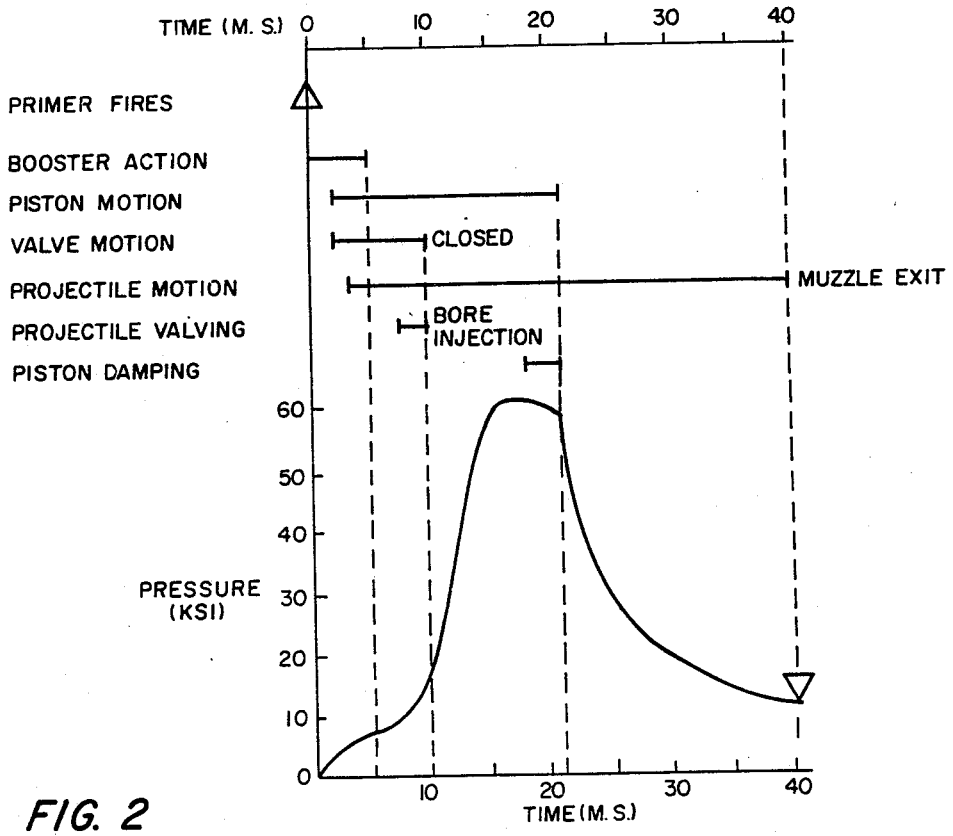
FIG. 2 is chart of cycle of operation of the gun system of FIG. 1.

An exemplary gun cycle is shown in FIG. 2.

After firing is completed, the piston 38 and the valve 36 are in their nested, forwardmost positions, as shown in the lower half of FIG. 1. The surface 48 of the valve annulus 40 serves to close the supply bores 156. After pressure in the combustion chamber is adequately vented and when allowed by the cam 176, the springs 82 biasing the rods 78 shift the valve aft to the position shown in the upper half of FIG. 1. The piston is still nested on the valve. As the valve is shifted aft, the supply bores 156 are uncovered by the surface 48, admitting liquid propellant forward of the annulus 40. The propellant flows through the annular passageway 44 into the cavity 56, through the passageways 77 into the cavity 60, into the supply cavity 116 and into the bores 74. When allowed by the cam 76, the pressure of the propellant unnests the piston aftwardly from the valve to define the pumping cavity 118 into which propellant flows from the bores 74. In the aftmost position of the valve, the surface 64 closes the inlet ends of all three pluralities of bores 124, 126 and 128. Thus no propellant can enter these bores and pass to the projectile receiving and combustion chamber 22. Various bores, typically 190, are provided to insure that the running surfaces between the valve and the piston 98 and 58 are lubricated with propellant. Additional bores, typically 194, are provided to assist in purging air from the system.

The round of ammunition 26 is inserted into the projectile chamber 22 by the bolt 32. The bolt is locked.

The firing pin 32a of the bolt 32 percusses the primer **30*a*, the primer fires and ignites the booster charge 30*b*. The combustion gas from the booster charge unseats the projectile from its case forwardly. Combustion gas passes through the bores 122 into the additional combustion chamber 120 and applies force against the aft face 112 of the piston, moving the piston forwardly to commence compression of the liquid propellant in the pumping chamber 118. Some propellant passes through the bores 115 into the additional combustion chamber 120 chamber and is ignited. The valve 36 is moved forwardly to commence reducing the volume of the supply cavity 116. When the forward corner of the surface 72 of the valve reaches the aft corner of the surface 46 of the barrel extension, the supply cavity 116 becomes a closed cavity whose only outlet is the bores 74, thereby providing a dash-pot action to cushion the nesting of the valve onto the barrel extension. While the projectile is in the projectile chamber 22 it closes the outlets of the plurality of bores 128 and the plurality of bores 126 and 124. As the valve moves forward it first uncovers the inlets of the bores 124 which permits the passage of liquid propellant from the pumping chamber 118 into the aft portion of the projectile chamber where it is ignited by the combustion gas from the booster charge, to increase the acceleration of the projectile over what has been provided by the booster charge per se and the propellant from the bores 115. When the valve is partially closed onto the barrel extension it uncovers the inlets to the bores 126, and when it is fully closed, it uncovers the inlets to the bores 128. When the projectile has moved forwardly down the firing bore 20 to uncover the outlets of the bores 126 and 128, additional liquid propellant is injected through these bores into the projectile chamber 22 and ignited. As liquid propellant passes out of the bores 128 into the annulus 130 it is deflected by the bulk combustion gas flow forwardly through the projectile chamber to provide a continuously replenished film or tube of liquid on the surface 134 which extends forwardly (down-stream) along the surface of the firing bore 20. This tube of liquid propellant encircles and feeds a tubular combustion zone. The tube of film insulates the adjacent surface of the firing bore from the heat of the combustion zone. As the piston 38 closes forwardly on the valve 36 it also is a closed cavity whose only outlets are the bores 115, 124, 126 and 128**, thereby providing a dash-pot action to cushion the nesting of the piston onto the valve.

As the piston moves forwardly during the firing subcycle, the annular portion 90 pushes against liquid propellant ahead of it in the forward portion 60*a* of the cavity 60. This forward portion serves as a closed cavity whose only outlets are the bores 77 and the bore 168. The bores 77 lead only to the cavity 56, which when the valve sleeve is in its forward nested position, is itself a fully closed cavity. The bore 168 communicates via the bore 166, the needle valve 164 and the bore 162 with the aft portion 60*b* of the cavity 60. The aft portion increases in volume as the forward portion decreases in volume. The rate of transfer between the portions is controlled by the needle valve. Thus, the cavity 60 with the needle valve circuit serves as an injection rate control system yielding direct performance adjustment. Any surplus liquid propellant developed as the difference between the volumes of the forward and the aft portions of the cavity 60 may be discharged via the pressure relief valve 160. Such discharged liquid propellant may be either dumped and lost, or passed through a cooling system 206, e.g. a radiator, and then returned to the liquid propellant supply system. A higher than conventional ratio of injection pressure to chamber pressure, e.g. 1.4 to 1, rather than 1.2 to 1, may be provided to permit a high initial acceleration until the valve sleeve closes and the needle valve circuit assumes control.

It will be noted that the cam track 178 serves to control the filling subcycle by its restraint of the aftward movement of the piston 38. It does not control or hinder the forward movement of the piston. However, should a misfire occur, such that the piston does not move forwardly during the time interval alloted to the firing cycle, then the cam track 178, via the followers 184 engaging the rod enlargements 174, will shift the piston forwardly. As the piston moves forwardly, the liquid propellant in the pumping cavity 118 is forced through the bores 74 into the supply cavity 116 and the cavity 56, through the bores 77 into the cavity 60, through the needle valve circuit and out through the pressure relief vavle 160.

The booster 30*b* is made powerful enough, so that, if ignited, it will generate a volume of combustion gas adequate to force the projectile forwardly through the length of the firing bore and out of the gun.

After the completion of the firing cycle, the bolt is unlocked and extracts the cartridge case. If a misfire has occurred such that the primer did not ignite the booster, the projectile will be extracted with the cartridge case. If the booster did ignite, only the cartridge case will remain with the bolt for extraction.

It will be noted that the cartridge case thus serves three functions. It provides a replaceable seal to close the aft end of the projectile chamber. It also provides a mechanism for extracting the projectile in the event of a misfire. In addition it provides a replaceable ignition system unavailable in other liquid propellant systems.

The aft end of the projectile which is received into the neck of the cartridge case may be provided with a plurality of longitudinal grooves 200 whose forward ends are closed by the forwardmost portion of the neck of the case. These grooves serve as passageways for booster combustion gas, deflecting open the case neck closures, to pass into the projectile cavity and through the bores 122 to apply force to the aft face of the piston.

The injection bores 115 through the piston may be omitted and all injection provided through the bores 124, 126 and 128. In this case only the projectile receiving chamber 22 serves as a combustion chamber. The chamber 120 will merely receive combustion gas through the bores 122 to advance the piston sleeve forwardly. In addition bore 124 could be eliminated with all injection provided through bores 126 and 128, or only one of them in which case the primer 30*a* alone or in combination with the booster 30*b* would move the projectile sufficiently to permit injection of the liquid propellant. Furthermore a mechanical device could be used to "jog" the projectile to open a bore or conduit opening into the bore to permit the flow of liquid propellant into the combustion chamber.

The cartridge case providing the replaceable seal and the replaceable ignition mechanism may be omitted and a permanent seal may be provided between the bolt and the chamber as shown in U.S. Pat. No. 3,996,837 issued Dec. 14, 1976 to E. Ashley et al, and a permanent igniter may be provided in the bolt as shown in U.S. Pat. No. 3,783,737 issued Jan 8, 1974 to E. Ashley. In this case some liquid propellant may be provided as a primer through the bores 115.

What is claimed is:

1. In a regenerative liquid propellant gun having a combustion space which includes that portion of the bore of the gun barrel behind the projectile before and during projectile acceleration during firing and wherein liquid propellant is injected through conduit means into the combustion space by means of force exerted on a body of liquid propellant in a dispensing reservoir by movement of a mechanical element responsive to the gaseous pressure in the combustion space during firing, the improvement wherein said conduit means comprises a passageway extending from said reservoir through the gun barrel to an opening into said bore at a location within the extent of that portion of the projectile to be fired which is in contact with the bore surface when said projectile is in its ready for firing position whereby the projectile acts as a valve to initially block flow of liquid propellant from said passageway into said bore and to subsequently permit such flow when the projectile moves down the barrel beyond said opening.

2. The improved regenerative liquid propellant gun of claim 1 wherein said conduit means further comprises a second passageway from said reservoir to a second opening into said bore within the extent of the said portion of the projectile in its ready for firing position, said two openings being spaced from one another longitudinally of said barrel whereby flow of liquid propellant to the combustion space is staged by the valving action of the projectile to increase the volume of flow during combustion.

3. The improved regenerative liquid propellant gun of claim 1 wherein said conduit means further comprises a plurality of additional passageways from said reservoir to a like number of openings into said bore within the extent of the said portion of the projectile, said openings being spaced from one another longitudinally of said barrel to provide multiple staging of flow of liquid propellant to said combustion space during projectile acceleration.

4. The improved regenerative liquid propellant gun of claim 1 wherein said conduit means further comprises an additional passageway from said reservoir to said combustion space through which flow of liquid propellant is controlled by an element other than a projectile.

5. The improved regenerative liquid propellant gun of claim 1 wherein the gun includes a breech surrounding the breech end of the barrel having a portion of the breech spaced from the barrel so as to form an enclosed annular cylinder about a portion of the barrel proximate the breech end thereof and wherein said mechanical element comprises an annular differential area piston journaled in said cylinder about said barrel for reciprocal motion longitudinally of said barrel dividing said cylinder into two annular portions of which one constitutes said reservoir and the other constitutes a part of said combustion space.

6. The improved regenerative liquid propellant gun of claim 5 wherein said conduit means further comprises a second passageway from said reservoir to a second opening into said bore within the length of the projectile in its ready for firing position, said two openings being spaced from one another longitudinally of said barrel whereby flow of liquid propellant to the combustion space is staged by the valving action of the projectile to increase the volume of flow during combustion.

7. The improved regenerative liquid propellant gun of claim 6 wherein said conduit means further comprises an additional passageway from said reservoir to said combustion space through which flow of liquid propellant is controlled by an element other than a projectile.

8. The improved regenerative liquid propellant gun of claim 6 wherein said gun includes means for imparting an initial forward motion to said projectile prior to combustion of liquid propellant flowing from said reservoir through said passageways whereby said means for imparting causes said projectile to uncover one said opening to permit propellant to reach said combustion space.

9. A liquid propellant gun comprising:

a gun barrel having a muzzle end, a breech end and a longitudinal bore, a portion of said bore proximate said breech end constituting a projectile chamber and a combustion space on the breech side of the projectile chamber;

a breech joined to and surrounding the breech end of said barrel and extending along a portion of the length of the barrel towards the muzzle end, said breech having a bore aligned with the barrel bore and having a breech block for opening and closing said bore to permit insertion of a projectile into the barrel, said breech also having an interior recessed wall forming with said breech block a closed annular cylindrical chamber about the breech end of the barrel;

an annular differential area piston disposed in said annular chamber and journaled between said recessed wall and said barrel for movement longitudinally thereof separating said annular chamber into two variable capacity annular subchambers, the one said subchamber on the muzzle side of the piston constituting a reservoir for a liquid propellant, the other side subchamber on the breech side of the piston being vented to the bore of the barrel to constitute a portion of the combustion space of the gun;

liquid propellant handling means including:

liquid transfer means in said breech for moving a liquid propellant from an external source into said reservoir, propellant injection means including at least one passageway to permit the flow of liquid propellant from said reservoir to said combustion space, at least one said passageway running from said reservoir through said barrel to terminate in an opening into said barrel bore at a location within said projectile chamber so as to be blocked by a projectile in position for firing; and means for igniting propellant in the combustion space;

whereby a projectile when loaded into the projectile chamber acts as a valve stopping flow of propellant from the said one passageway until the projectile moves beyond its opening, and whereby liquid propellant is forced through said passageways to the combustion space by the force of combustion action on said annular piston.

10. A liquid propellant gun according to claim 9 wherein said propellant injection means comprises two said passageways, each running from said reservoir through said barrel to terminate in an opening into said barrel bore at a location within said projectile chamber, said openings being spaced from each other longitudinally of said barrel whereby they are uncovered sequentially by said projectile to provide a staged increase of volume of flow of liquid propellant during projectile acceleration.

* * * * *